United States Patent [19]

Scharer

[11] Patent Number: 4,607,993

[45] Date of Patent: Aug. 26, 1986

[54] COMBINED PUNCH AND BINDING MACHINE WITH THICKNESS GAUGE AND BACK GAUGE PLATE ADJUSTMENT

[75] Inventor: Roger M. Scharer, Des Plaines, Ill.

[73] Assignee: General Binding Corporation, Northbrook, Ill.

[21] Appl. No.: 795,077

[22] Filed: Nov. 5, 1985

[51] Int. Cl.[4] ..... B42B 5/10; B26D 5/08

[52] U.S. Cl. ..... 412/40; 83/622

[58] Field of Search ..... 412/16, 40; 83/618, 83/668, 147, 622; 33/169 B, 143 M, 143 R

[56] References Cited

U.S. PATENT DOCUMENTS

| | | | |
|---|---|---|---|
| 3,060,780 | 10/1962 | Stuckens | 412/40 |
| 3,122,761 | 3/1964 | Bouvier | 412/40 |
| 3,125,887 | 3/1964 | Bouvier et al. | 412/40 |
| 3,227,023 | 1/1966 | Bouvier | 83/622 |
| 3,699,596 | 10/1972 | Lyon | 412/40 |
| 3,793,660 | 2/1974 | Sims | 412/40 |
| 3,996,667 | 12/1967 | Barnard | 33/143 R |
| 4,165,566 | 8/1979 | Lycan | 33/169 R |

*Primary Examiner*—Paul A. Bell

*Assistant Examiner*—Paul M. Heyrana

*Attorney, Agent, or Firm*—Hill, Van Santen, Steadman & Simpson

[57] ABSTRACT

There is disclosed herein a combined punch and binding machine which includes a frame, a plurality of pin receiving die openings, and a punch mechanism carried on the frame. An adjustable back gauge plate is provided for engaging an edge of the material to be punched and is positioned rearwardly of the die openings. The plate has a forwardly extending slide for adjusting the plate relative to the die openings and an adjustment indicia are carried on the slide. A cover is provided for covering the punch mechanisms and through the adjustment slide and for alignment with the indicia on the slide. A thickness gauge is carried on the cover for measuring the thickness of the material to be punched as the indicia thereon for indicating the measured thickness. The thickness indicia on the gauge is correlated to the adjustment indicia on the adjustment slide so that the position of the back gauge plate is set relative to the measured thickness of material to be punched.

4 Claims, 10 Drawing Figures

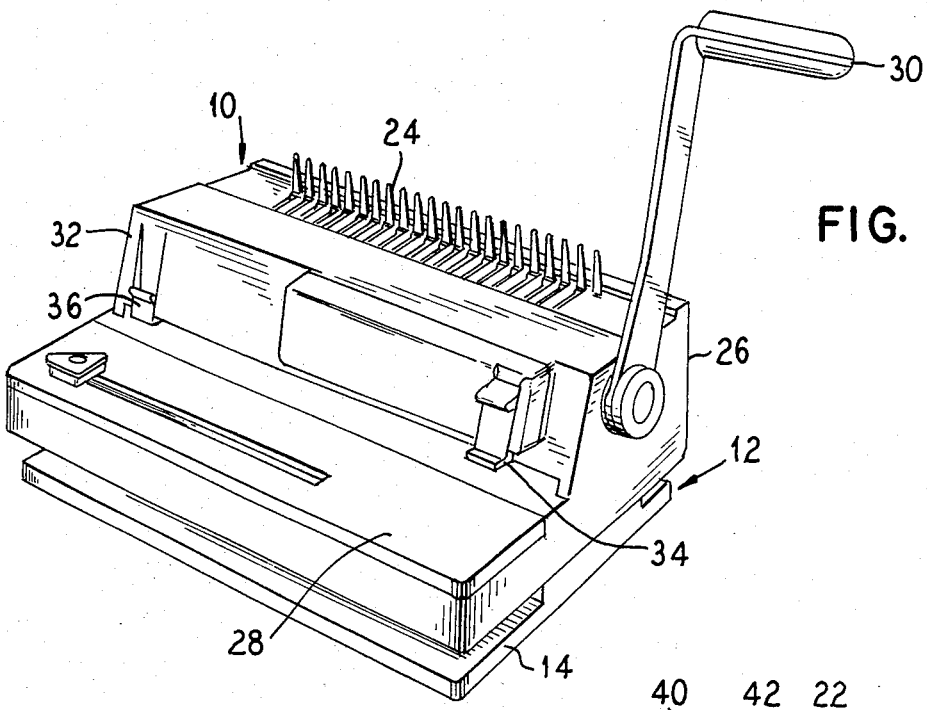
FIG. 1
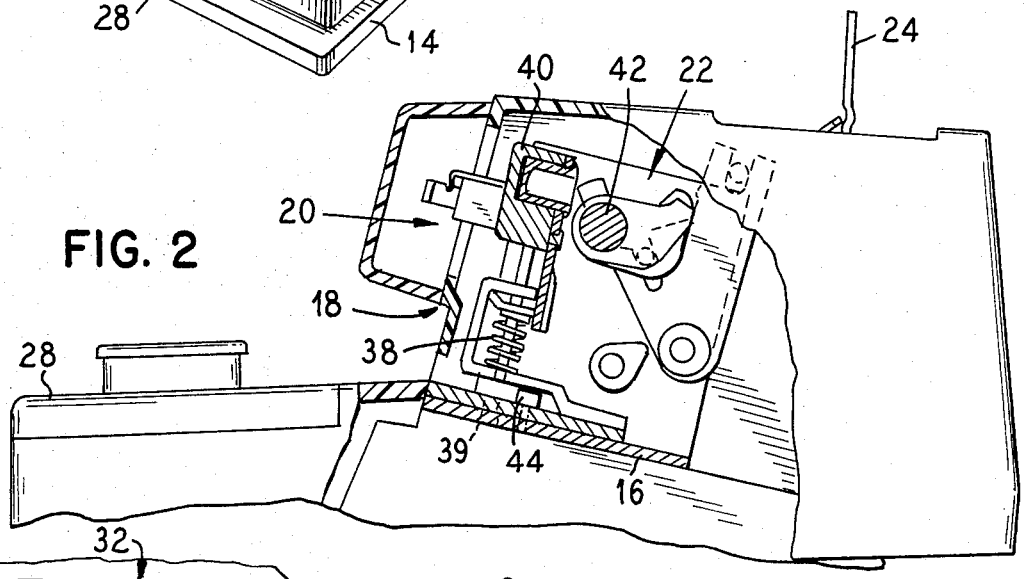
FIG. 2
FIG. 3
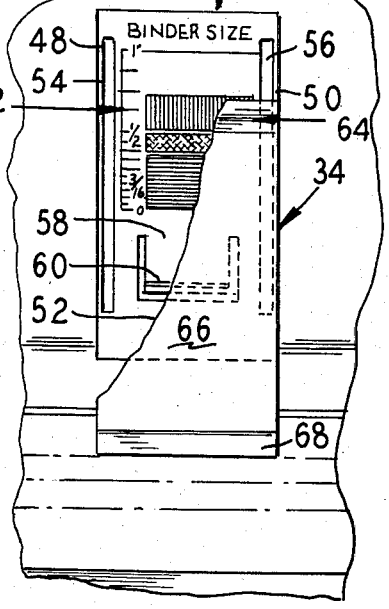
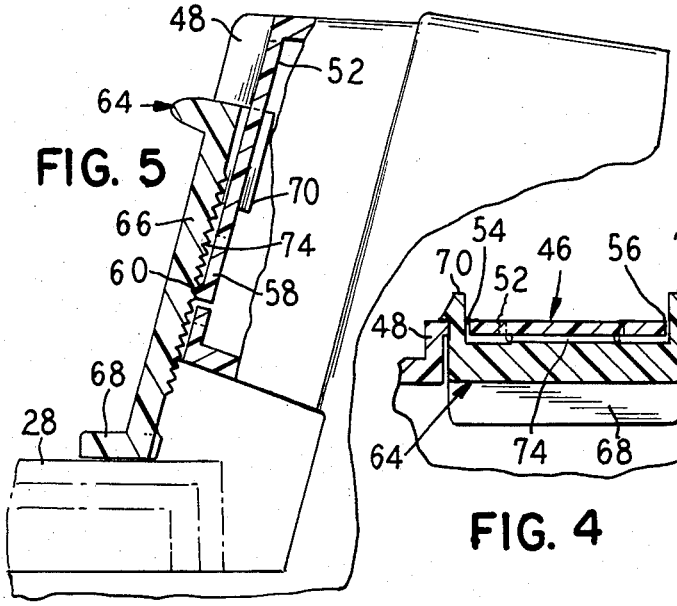
FIG. 5
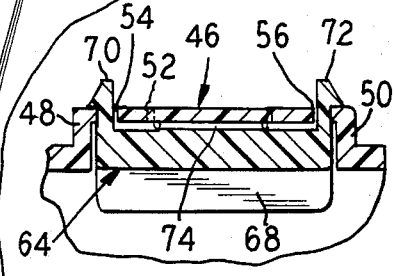
FIG. 4

COMBINED PUNCH AND BINDING MACHINE WITH THICKNESS GAUGE AND BACK GAUGE PLATE ADJUSTMENT

BACKGROUND OF THE INVENTION

This invention relates to punch and binding machines, and more specifically, to mechanisms for cooperatively gauging the thickness of material to be punched and adjusting the punching mechanism in accordance therewith.

Punch and binding machines are used for punching binding apertures in paper or text material and covers, and thereafter binding the punched materials with a binder element of the type having a backbone and curled binding fingers so as to form a book, chart or the like. The binding mechanism opens or uncurls the binder element fingers so that the punched material may be impaled thereon at the binding apertures, and then bound when the fingers are released and recurl. Combined punch and binding machines are shown in U.S. Pat. Nos. 3,122,761; 3,125,887; 3,227,023 and 3,793,660. Binder elements are shown in U.S. Pat. No. 1,970,285.

In practice, different sized or diameter binder elements are used to bind different thicknesses of paper or other material. For example, binder elements are available in 3/16-, ½-, 1- and 2-inch diameter sizes. It has been found that along the bound edge, the distance between the edge and the binding aperture (edge/aperture dimension) should be adjusted for different thicknesses of material being bound. More specifically, the edge/aperture dimension should increase as the thickness of bound material increases. Thus the edge/aperture dimension is less for material 3/16" of an inch thick than for one inch of material.

In the prior punch and binding machines, there is no provision for measuring material thickness and directly relating that thickness to the edge/aperture dimension. Furthermore, in such machines the edge/aperture dimension is determined by an adjustable back gauge plate. In U.S. Pat. No. 3,793,660, the position of that plate is adjustable in relation to the selected binder size by a gear-type mechanism. However, it has been determined to be desirable to eliminate the rotary positioning mechanism.

It is therefore an object of this invention to provide a thickness measuring device in association with a punch and binding machine.

It is another object of this invention to provide a back gauge plate positioning device cooperatively associated with said thickness measuring device.

It is a further object of this invention to provide a non-gear back plate adjustment mechanism.

These and other objects of this invention will become apparent from the following description and appended claims.

SUMMARY OF THE INVENTION

There is disclosed herein a combined punch and binding machine having a thickness gauge thereon for measuring the thickness of material to be punched which includes indicia for indicating thickness and selecting binder element size and for use in varying and setting the back gauge plate position. There is also provided an extendable slide mechanism on the front of said machine for varying the position of the back gauge plate in relation to thickness measurement. The slide includes indicia corresponding to the indicia on the thickness gauge for positioning the slide, and thus the back gauge plate.

Thus the thickness of material to be punched can be determined, the binder size selected, and the edge/aperture dimension adjusted in accordance with the thickness measurement.

BRIEF DESCRIPTION OF THE DRAWINGS

FIG. 1 is a perspective view of a combined punch and binding machine showing on the front thereof a thickness gauge and a back gauge plate adjustment slider;

FIG. 2 is a vertical sectional view showing the punch mechanism and actuator;

FIG. 3 is a plan view showing a slide-type thickness gauge;

FIG. 4 is a horizontal sectional view showing the assembled thickness gauge;

FIG. 5 is a vertical sectional view showing the assembled thickness gauge;

DESCRIPTION OF THE PREFERRED EMBODIMENT

Figure 6:
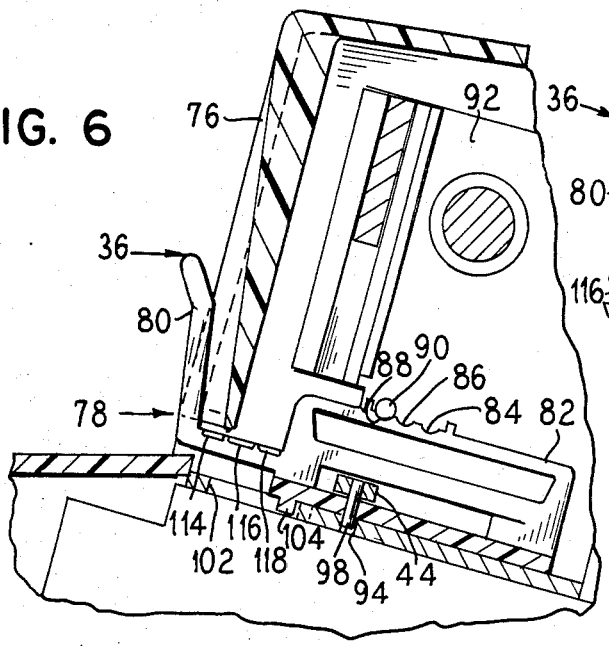
FIG. 6 is a fragmentary vertical sectional view showing the back gauge plate slide adjustment in a retracted position.

Referring now to FIG. 1, there is shown a combined punch and binding machine 10, generally, which includes a frame 12 having a base portion 14 and a mechanism supporting portion 16. A punch and binding mechanism 18, generally, is carried on the support portion 16 and includes a punch mechanism 20, an actuator mechanism 22 and a binding comb 24.

As seen in FIG. 1, a cover 26 is provided which covers the mechanism, through which the binding comb 24 extends and which defines a support table 28, generally. An actuator handle 30 extends through the cover 26. The front face of the cover 32 carries a vertically slidable thickness gauge 34 along the right-hand side, and an inwardly and outwardly movable back gauge plate adjusting slide 36 along the left-hand side.

The punch mechanism 18 includes a laterally extending row of aligned punch assemblies 38, which are actuated by the upwardly and downwardly movable pressure bar assembly 40. The actuator mechanism 22 is connected to the handle 30 so that rotation of the handle 30 rotates the actuator shaft 42, which in turn engages the pressure bar 40 causing it to press the punch assembly 38 downwardly. Reverse rotation of the actuator handle lifts the pressure bar and cooperates in stripping the punches from the punched material. Rotation of the acutator mechanism 22 also activates the binding comb 24 in a manner described in the previouly mentioned patents. The back gauge plate 44 is seen in FIG. 2 positioned rearwardly of the downwardly extending punch in assembly 38.

Referring now to FIG. 3 and the thickness measuring member or gauge, the front cover 32 is provided at the right-hand side with a generally U-shaped channel-like slot 46 having sidewalls 48 and 50 and back wall 52. The back wall 52 includes a pair of elongated tab receiving slots 54 and 56 adjacent each of the corners formed by the back wall with a sidewall. A resilient and forwardly biased ratchet-like tab 58 is provided at the center of the back wall 52 and includes a forwardly extending ratchet finger 60. Indicia for indicating the thickness of material being measured and binder size is applied on the back wall at 62.

A slide member 64, generally, is provided for cooperation with the U-shaped channel 46 and the material to be measured. The slide includes a body section 66 having a material engaging lower end 68 and a pair of snap tabs 70 and 72 at its upper end. The snap tabs fit through the slots 54 and 56 and snappingly engage the cover so as to retain the slide and guide in its vertical movement. Vertically extending ratchet teeth 74 are molded along the center of the back of the body portion 66 for engagement with the ratchet member 58 and tooth 60 so as to vertically position the slide member 64 relative to the cover.

The material whose thickness is to be measured is placed on the support table 28 below the thickness gauge and the slide member 64 is moved downwardly until the material engaging end 68 engages the material to be punched. At that point the thickness of the material is determined by viewing the indicia opposite the top edge of the slide. The indicia also indicates the setting for the edge aperture dimension as well as the binder size.

Figure 7:
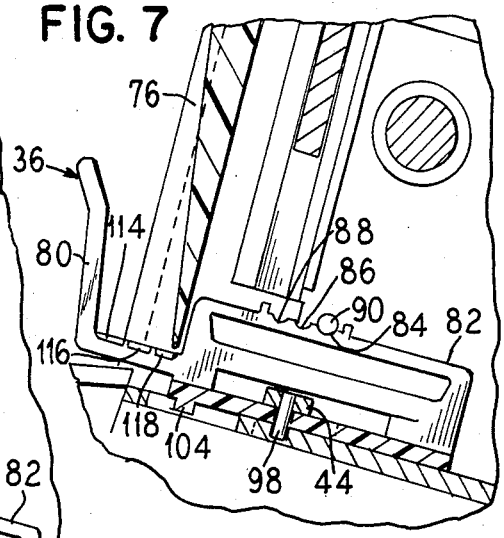
FIG. 7 is a view similar to FIG. 6 showing the slide adjustment in an extended position.
Figure 8:
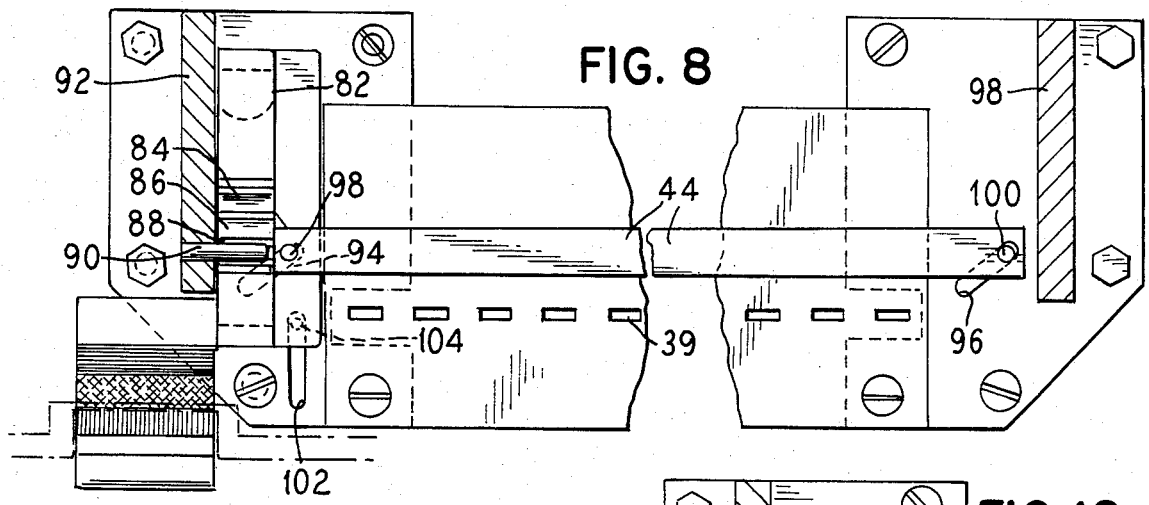
FIG. 8 is a fragmentary plan view showing the slide and back gauge plate adjustment mechanism.

Referring now to the back plate adjustment mechanism 36, it is seen that on the left-hand side the cover forms a recess 76 at which the slide end of the adjustment mechanism 36 is positioned. The mechanism includes the back gauge plate 44 and a molded slide and detent member 78. The slide and detent member 78 is best seen in FIGS. 6–8 and includes an upwardly extending pull or slide 80, which is laterally offset, but integral with the detent forming section 82. Detents, such as 84, 86 and 88, are formed on the outward side of the portion 82 for engagement with a detent pin 90 that extends from side plate 92. The detents are formed in a thin walled top section, which is resilient and biased so as to permit vertical movement of the detents in positioning of the molded member relative to the fixed detent pin 90.

Forward and rearward movement of the back gauge plate 44 is controlled by a plurality of cam pins and slots. A pair of diagonal slots 94 and 96 are formed in the bottom surface of each of the side plates, such as 92, and cooperate with pins 98 and 100 in moving the back gauge plate forwardly or rearwardly with respect to the punch apertures 39. The forwardly and rearwardly extending slot 102 and pin 104 guide the molded slide and detent member 78 in a forward and rearward direction.

Figure 9:
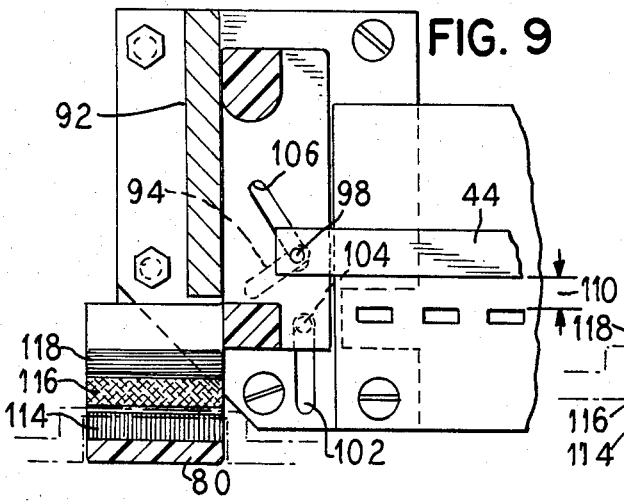
FIG. 9 is a fragmentary plan view showing the slide in its retracted position and the back gauge plate set for the maximum edge/aperture dimension.
Figure 10:
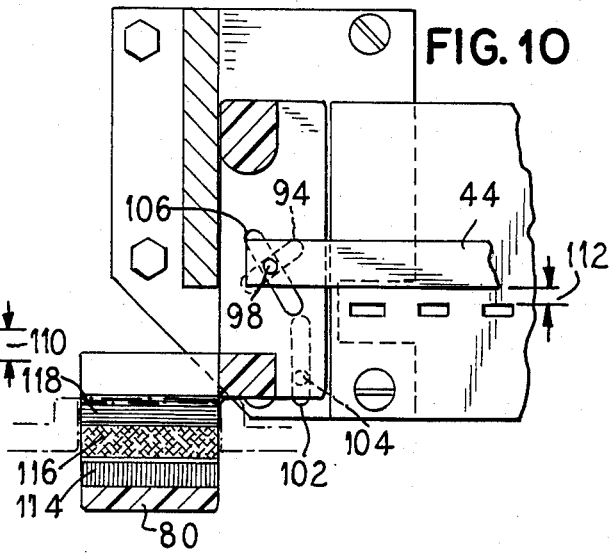
FIG. 10 is a fragmentary plan view showing the slide in its extended position and the back gauge plate set for the minimum edge/aperture dimension.

The diagonal cross slot 106 formed in the molded member 80 cooperates with the pin 98 and slot 94 in assuring aligned forward and rearward movement of the cross bar 44. With the pull 80 in its rearwardmost and retracted position, the edge/aperture distance (i.e., the distance between the punch receiving die opening 39 and back gauge plate 44) is at its maximum as indicated by the dimension 110 in FIG. 9. With the pull 80 in the extended and most forward position, the edge/aperture dimension is at its minimum as shown by numeral 112. Note the change in position of the detent pin 90 from detent notch 88 to notch 84. The position of the respective slots and pins are seen in FIGS. 9 and 10. The position of the molded member and hence the back gauge plate is set in accordance with indicia, such as 114, 116 and 118 which is on the substantially horizontal top surface of the molded member. This indicia is aligned with the edge of the cover in recess 76 as the indicator.

Thus, the thickness of the paper to be punched is determined using the gauge 34 and indicia indicated at 62. The position of the back gauge plate 44 is then set by aligning the cover recess 76 with the related indicia 114, 116 or 118. Thus, in one machine there is provided the apparatus for measuring thickness and adjusting the edge/aperture dimension in accordance therewith.

Although the invention has been described with respect to preferred embodiments, it is not to be so limited as changes and modifications can be made which are within the full intended scope of the invention as defined by the appended claims.

I claim as my invention:

1. A punch and binding machine which includes:

a frame;

means carried by said frame defining a plurality of punch receiving die openings;

a punch mechanism carried on said frame and including an adjustable back gauge plate for engaging an edge of material to be punched, said plate positioned rearwardly of said die openings, and said plate having a forwardly extending slide means for adjusting said plate relative to said die openings, and adjustment indicia carried on said slide;

cover means for covering said punch mechanism through which said adjustment slide extends and for alignment with said indicia on said slide; and thickness gauge means carried on said cover for measuring the thickness of material to be punched and having indicia for indicating the measured thickness;

said thickness indicia on the gauge correlated to the adjustment indicia on the adjustment slide member so that the position of the back gauge plate is set relative to the measured thickness of material to be punched.

2. A machine as in claim 1, wherein said thickness gauge means includes means in said cover defining a substantially vertical channel, said thickness indicating indicia being positioned on said channel, and slide means movable in said channel to engage said thickness to be measured and to be aligned with thickness measuring indicia.

3. A machine as in claim 2, wherein ratchet means are provided on said thickness slide and channel for releasably securing said slide in a substantially vertical position in said channel.

4. A machine as in claim 1, wherein said back plate adjustment slide includes means defining a pull for adjusting the position of the back gauge plate and detent means for releasably securing said back gauge plate in a preselected position corresponding to the indicia on said mechanism.

* * * * *